US005643141A

United States Patent [19]

Lee

[11] Patent Number: 5,643,141

[45] Date of Patent: Jul. 1, 1997

[54] LEG EXERCISER

[76] Inventor: Sunny Lee, No. 257-8, Chung-Cheng Rd., Tsao-Tun Chen, Nan-Tou Hsien, Taiwan

[21] Appl. No.: 693,339

[22] Filed: Aug. 6, 1996

[51] Int. Cl.[6] ..... A63B 22/04; A63B 21/02

[52] U.S. Cl. ..... 482/52; 482/123; 482/130

[58] Field of Search ..... 482/51, 52, 53, 482/121, 122, 123, 111, 130, 132, 137, 138, 57, 129

[56] References Cited

U.S. PATENT DOCUMENTS

| | | | |
|---|---|---|---|
| 4,850,585 | 7/1989 | Dalebout | 482/51 |
| 4,861,023 | 8/1989 | Wedman | 482/51 |
| 4,940,233 | 7/1990 | Ball et al. | 482/52 |
| 5,000,443 | 3/1991 | Dalebout et al. | 482/51 |
| 5,419,747 | 5/1995 | Piaget et al. | 482/51 |
| 5,419,748 | 5/1995 | Snyderman et al. | 482/123 |
| 5,496,235 | 3/1996 | Stevens | 482/51 |
| 5,527,251 | 6/1996 | Davis | 482/51 |

*Primary Examiner*—Stephen R. Crow
*Attorney, Agent, or Firm*—Timothy N. Trop

[57] ABSTRACT

A leg exerciser includes a base, two posts fixed on the base, a handle fixed on upper end portions of the posts, two swing arms respectively pivoted to the posts, and two resistance adjusting mechanisms. Each of the mechanisms includes two adjusting rods and two resilient band units. The two adjusting rods are mounted pivotally on one of the posts. Each of the adjusting rods is pivotable about a horizontal axis and is locked on a selected one of several angular positions on a corresponding one of the posts. One of the two adjusting rods extends forward from a corresponding one of the posts while the other one extends rearward from the corresponding one of the posts. Each of the adjusting rods has an inner end portion which is pivoted to a corresponding one of the posts, and an outer end portion which is provided with a lower band retainer. Each of the band units is retained on an upper band retainer of a corresponding one of the swing arms and one of the lower band retainers. The resistance adjusting mechanisms are adjustable so as to provide different resistances to forward and rearward movement of each of the swing arms.

4 Claims, 5 Drawing Sheets

LEG EXERCISER

BACKGROUND OF THE INVENTION

1. Field of the Invention

This invention relates to a leg exerciser, more particularly to a leg exerciser which can provide different exercising resistances and which is foldable.

2. Description of the Related Art

Referring to FIG. 1, a conventional leg exerciser 10 is shown to comprise a frame body 11. The front end of the top frame of the frame body 11 has a transverse grasp rod 111 connected thereto. The rear end of the top frame of the frame body 11 has a pair of walking units 12 connected pivotally thereto. Each of the walking units 12 has a pedal 121 connected thereto so that a user can stand on the latter and move his feet back and forth for exercising purposes. However, the exercising resistance which is applied by the conventional leg exerciser against the movement of the user's feet is fixed and cannot be adjusted. Moreover, the conventional leg exerciser cannot be folded, thereby resulting in difficulty during transport and storage of the leg exerciser.

SUMMARY OF THE INVENTION

Therefore, an object of the present invention is to provide a leg exerciser in which the exercising resistance can be adjusted.

Another object of the present invention is to provide a leg exerciser which is foldable in order to facilitate transport and storage thereof.

According to this invention, a leg exerciser includes a base, two aligned posts which are fixed on the base, and a handle which is fixed on upper end portions of the posts for gripping purpose. Two aligned swing arms are respectively pivoted to the upper end portions of the posts. Each of the swing arms has a pedal which is fastened to a lower end portion thereof, and an upper band retainer which is fastened to an upper end portion of the swing arm. Two resistance adjusting mechanisms are disposed on the posts respectively so as to adjust resistance to the swinging movement of the swing arms. Each of the resistance adjusting mechanisms includes two adjusting rods which are mounted pivotally on one of the posts in such a manner that each of the adjusting rods is pivotable about a horizontal axis and that each of the adjusting rods is locked on a selected one of several angular positions on the corresponding posts. One of the two adjusting rods extends forward from a corresponding one of the posts while the other one of the two adjusting rods extends rearward from the corresponding with posts. Each of the adjusting rods has an inner end portion which is pivoted to the corresponding one of the posts at a position below the upper band retainers, and an outer end portion which is provided with a lower band retainer. Two inclined and tautened resilient band units have upper end portions which are retained on the upper band retainer of the corresponding one of the swing arms, and lower end portions which are respectively retained on the lower band retainers of the two adjusting rods. The resistance adjusting mechanisms are adjustable to vary the distance between the upper band retainer and the lower band retainers on one of the posts, so as to provide different resistances to forward and rearward movement of each of the swing arms.

BRIEF DESCRIPTION OF THIS DRAWINGS

Other features and advantages of the present invention will become apparent in the following detailed description of a preferred embodiment of the invention, with reference to the accompanying drawings, in which.

DETAILED DESCRIPTION OF THE PREFERRED EMBODIMENT

Figure 1:
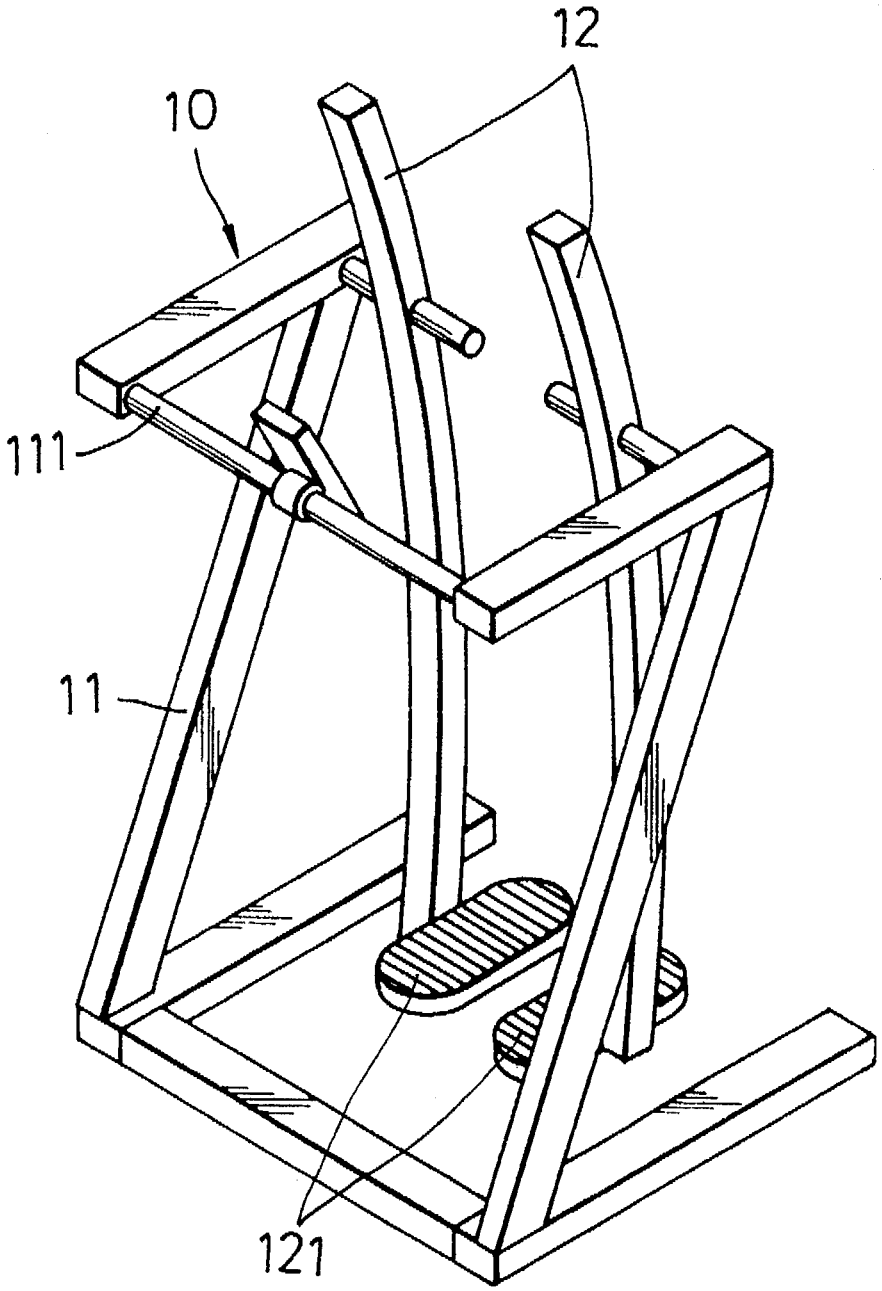
FIG. 1 PRIOR ART
FIG. 1 is a perspective view of a conventional leg exerciser.
Figure 2:
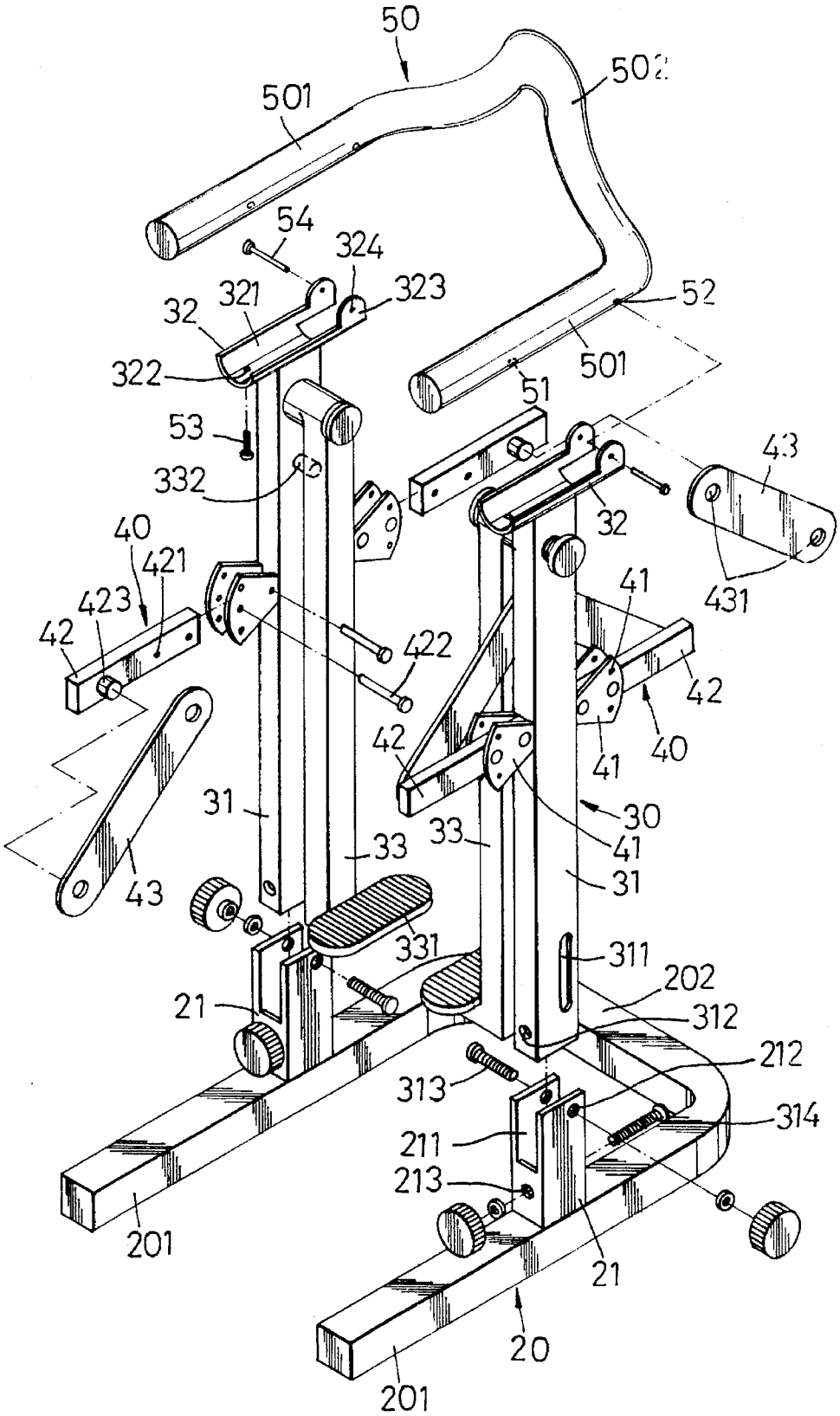
FIG. 2 is a partly exploded view of a preferred embodiment of a leg exerciser according to the present invention.
Figure 3:
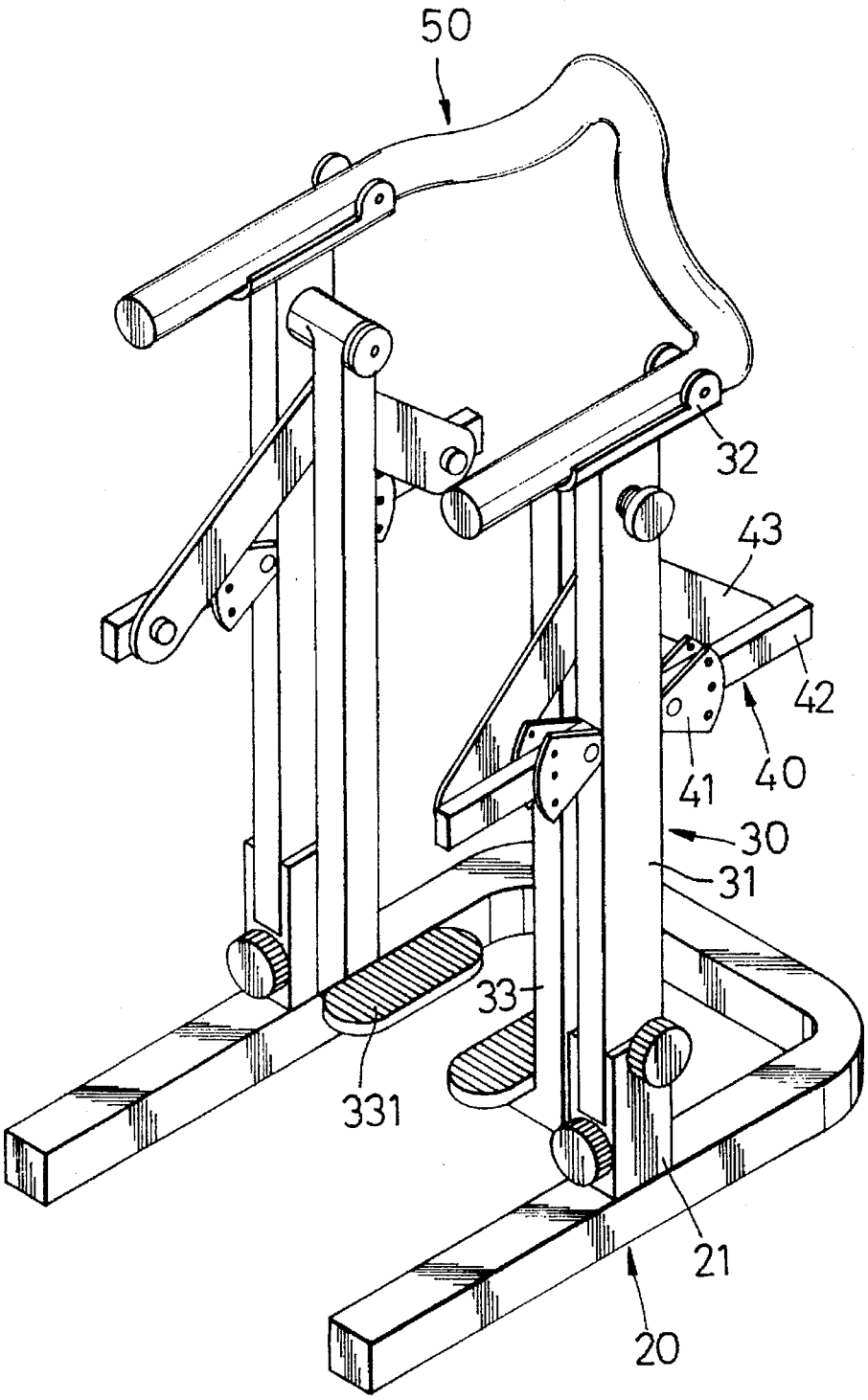
FIG. 3 is a perspective view of the preferred embodiment of the leg exerciser according to the present invention.

Referring to FIGS. 2 and 3, the preferred embodiment of a leg exerciser according to the present invention is shown to comprise a U-shaped base 20, a walking unit 30, two resistance adjusting mechanisms 40, and a handle 50.

The base 20 has two parallel longitudinal rod sections 201 and a transverse rod section 202 which interconnects the longitudinal rod sections 201. Each of the longitudinal rod sections 201 is provided with a fixed and U-shaped bracket 21 which has aligned front and rear side walls formed with lock holes 213, aligned left and right side walls formed with pivot holes 212, and an accommodating space 211 defined between the front and rear side walls and between the left and right side walls.

The walking unit 30 comprises two aligned posts 31, two support units 32 and two aligned swing arms 33. The lower end portion of each of the posts 31 has a slide slot 311 and a lock hole 312. Each of the posts 31 is inserted into the space 211 of a corresponding one of the brackets 21 in such a matter that a pivot bolt 313 extends through the pivot holes 212 and the slide slot 311, and that a lower lock bolt 314 extends through the lock hole 213 of the bracket 21 and the lock hole 312 of the post 31. Each of the support units 32 includes a curved support plate 321 secured to the upper end of one of the posts 31 and having a threaded hole 322, and a pair of aligned lugs 323 with pivot holes 324. The swing arms 33 are respectively pivoted to the upper end portions of the posts 31. Each of the swing arms 33 has a pedal 331 which is fastened to the lower end portion thereof. An upper band retainer 332 is fastened to the upper end portion of each of the swing arms 33. In this embodiment, each upper band retainer 332 is an upper stub which projects horizontally from a corresponding one of the swing arms 33.

The handle 50 is generally U-shaped and has two parallel longitudinal arms 501 and a connecting rod 502 which interconnects securely the longitudinal arms 501. Each of the longitudinal arms 501 has a threaded hole 51 and a pivot hole 52. Each of the longitudinal arms 501 is supported on the corresponding support plate 321 in such a manner that an upper lock bolt 53 extends through the lock hole 322 and the threaded hole 51, and that a pivot pin 54 extends through the pivot holes 324 and the pivot hole 52. Thus, the user can grip the handle 50 when the exerciser is in use.

The resistance adjusting mechanisms 40 are disposed on the posts 31 respectively so as to adjust resistance to the swinging movement of the swing arms 33. Each of the resistance adjusting mechanisms 40 includes two adjusting rods 42 and two inclined and tautened resilient band units 43. Each of the posts 31 is provided with two fixed positioning members 41, each of which has several angularly equidistant positioning holes 411 that are formed therethrough. In this embodiment, there are three holes 411 in each of the positioning members 41.

One of the two adjusting rods 42 extends forward from a corresponding one of the posts 31. The other one of the two adjusting rods 42 extends rearward from the corresponding one of the posts 31. Each of the adjusting rods 41 has an inner end portion and an outer end portion. The inner end portion has a locking hole 421 and is pivoted to a corresponding one of the positioning members 41 at a position below the upper band retainers 332 in such a matter that a positioning bolt 422 extends through the locking hole 421 and a selected one of the positioning holes 411 so as to lock the adjusting rod 42 on a corresponding one of the posts 31, thus forming a predetermined angle between the adjusting rod 42 and the corresponding one of the posts 31. Each of the adjusting rods 42 is pivotable about a horizontal axis when the positioning bolt 422 is removed from the adjusting rod 42. The outer end portion of each of the adjusting rods 42 is provided with a lower band retainer 423. In this embodiment, each lower band retainer 423 is a lower stub which projects horizontally from a corresponding one of the adjusting rods 42.

The two resilient band units 43 have upper end portions which are retained on the upper band retainer 332 of a corresponding one of the swing arms 33, and lower end portions which are respectively retained on the lower band retainers 423 of the two adjusting rods 42. Each of the resilient band units 43 may consist of one or more resilient bands. In this embodiment, each of the resilient band units 43 is a band which has two retaining holes 431 that are respectively formed through two end portions thereof. Each of the upper and lower band retainers 332 and 423 is engaged within one of the retaining holes 431 of the bands. The resistance adjusting mechanisms 40 are adjustable to vary the distance between the upper band retainer 332 and the lower band retainers 423 on one of the posts 31, so as to provide different resistances to forward and rearward movement of each of the swing arms 33.

Figure 4:
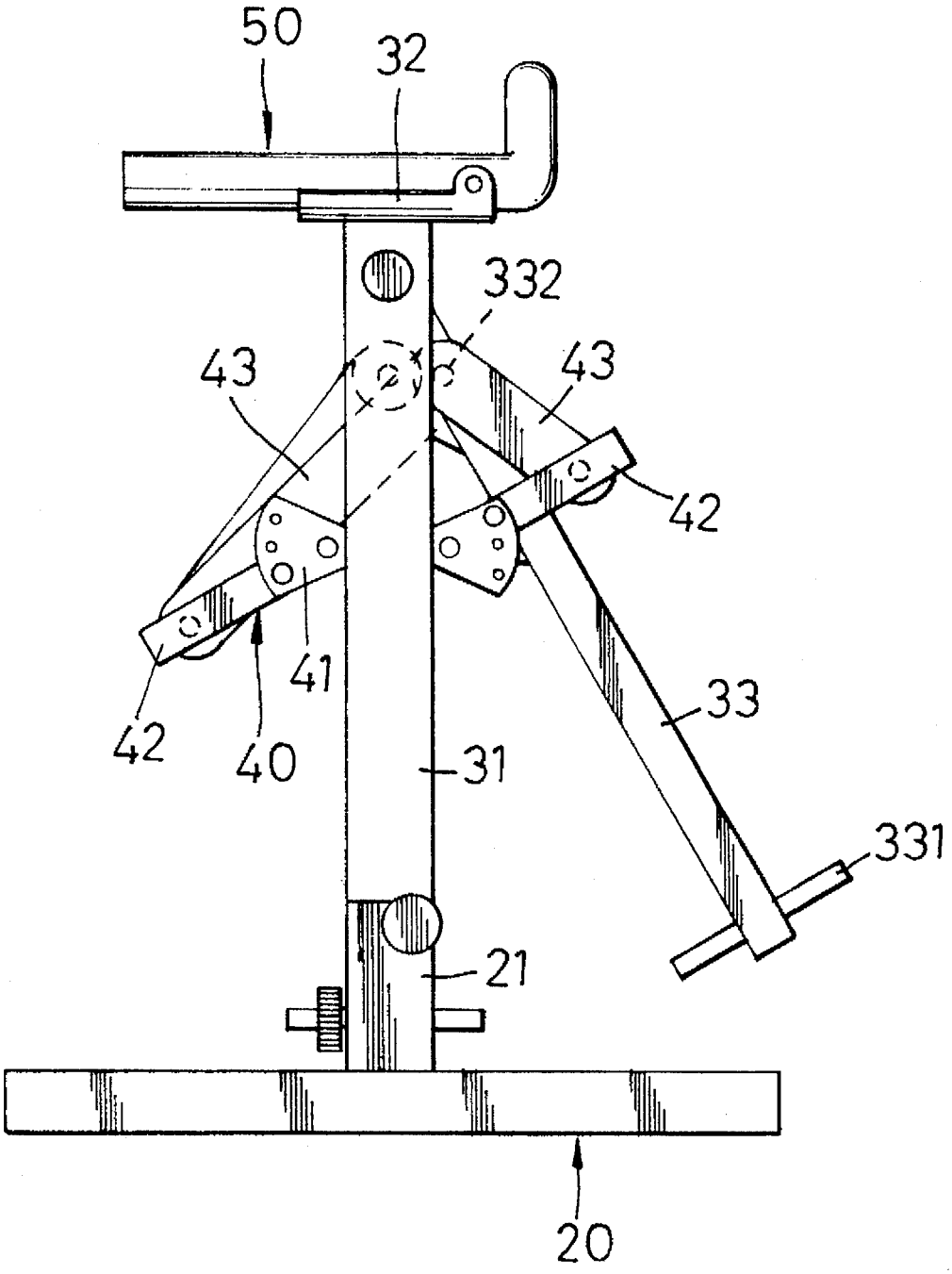
FIG. 4 is a schematic view illustrating the preferred embodiment of the leg exerciser in an operative position.

In use, with reference to FIG. 4, upon adjustment of the adjusting rods 42, the distance between the outer end portions of the front lower band retainers **423*a* and the upper band retainers 332 is shorter than that between the rear lower band retainers 423*b* and the upper band retainers 332, so that the front bands 42 are loosened and the rear bands 42 are tightened. The user is able to stand on the pedals 331 to move his legs back and forth for exercising purpose. When in use, the bands can provide a given resistance against the movement of the walking unit 30. In this situation, the resistance to the forward movement of the swing arms 33 is greater than that to the rearward movement of the swing arms 33**.

Figure 5:
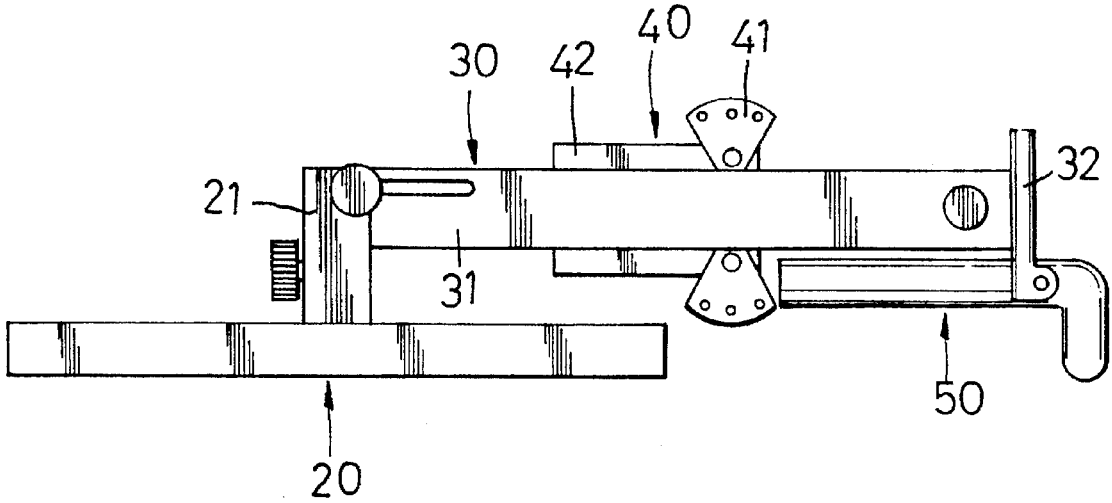
FIG. 5 is a side view illustrating the preferred embodiment of the leg exerciser in a folded position.

When the leg exerciser is not in use and is to be stored, as shown in FIG. 5, the upper lock bolts 53 (see FIG. 2) are removed from the handle 50 and the handle 50 is rotated so as to be parallel with the posts 31. The positioning bolts 422 (see FIG. 2) are removed from the rods 42 and the bands 43 are removed from the adjusting rods 42 and the swing arms 33 in order to allow the adjusting rods 42 to be rotated so as to be parallel with the posts 42. Finally, the lower lock bolts 314 are removed from the connecting members 21 and the posts 31. The posts 31 are moved upward and rotated on the base 20 so as to be parallel with the longitudinal rod sections 201.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A leg exerciser, comprising:

a base;

two aligned posts fixed on said base;

a handle fixed on upper end portions of said posts;

two aligned swing arms respectively pivoted to the upper end portions of said posts, each of said swing arms having a pedal fastened to a lower end portion thereof, and an upper band retainer fastened to an upper end portion of said swing arm; and two resistance adjusting mechanisms disposed on said posts respectively so as to adjust resistance to swinging movement of said swing arms, each of said resistance adjusting mechanisms including:

two adjusting rods mounted pivotally on one of said posts in such a manner that each of said adjusting rods is pivotable about a horizontal axis and that each of said adjusting rods is locked on a selected one of several angular positions on a corresponding one of said posts, one of said two adjusting rods extending forward from a corresponding one of said posts, the other one of said two adjusting rods extending rearward from the corresponding one of said posts, each of said adjusting rods having an inner end portion pivoted to a corresponding one of said posts at a position below said upper band retainers, and an outer end portion provided with a lower band retainer; and two inclined and tautened resilient band units having upper end portions retained on said upper band retainer of a corresponding one of said swing arms, and lower end portions respectively retained on said lower band retainers of said two adjusting rods, said resistance adjusting mechanisms being adjustable to vary distance between said upper band retainer and said lower band retainers on one of said posts, so as to provide different resistances to forward and rearward movement of each of said swing arms.

2. A leg exerciser as claimed in claim 1, wherein each of said posts is provided with two fixed positioning members, each of which has several angularly equidistant positioning holes formed therethrough, each of said adjusting rods having a locking hole formed therethrough, and a positioning bolt extending through said locking hole and a selected one of said positioning holes so as to lock said adjusting rod on a corresponding one of said posts, thus forming a predetermined angle between said adjusting rod and the corresponding one of said posts.

3. A leg exerciser as claimed in claim 1, wherein each of said upper band retainers is an upper stub projecting horizontally from a corresponding one of said swing arms, each of said lower band retainers being a lower stub projecting horizontally from a corresponding one of said adjusting rods, each of said resilient band units being a band which has two retaining holes respectively formed through two end portions thereof, each of said upper and lower stubs being engaged within one of said retaining holes of said bands, each of said adjusting rods being rotatable on a corresponding one of said posts so as to vary distance between said upper band retainer and said lower band retainers on one of said posts, thus adjusting tension of a corresponding one of said resilient band units.

4. A leg exerciser as claimed in claim 3, wherein each of said adjusting rods is pivoted to said posts in such a manner that said adjusting rods are rotatable so as to be parallel with said posts when said positioning bolts are removed from said adjusting rods and when a corresponding one of said bands is removed from said adjusting rod and a corresponding one of said swing arms, said base being substantially U-shaped and having two parallel longitudinal rod sections and a transverse rod section which interconnects said longitudinal rod sections, said posts being mounted respectively and pivotally on said longitudinal rod sections of said base, each of said posts including a lower lock bolt for locking said post on said base in such a manner that said longitudinal rod sections of said base are rotatable so as to be parallel with said posts when said lower lock bolt is removed from said post and said base, said handle being generally U-shaped and having two parallel longitudinal arms and a connecting rod interconnecting securely said longitudinal arms, said longitudinal arms of said handle being mounted respectively and pivotally on said posts, each of said longitudinal arms of said handle including an upper lock bolt for locking said arm on one of said posts in such a manner that said arms of said handle is rotatable so as to be parallel with said posts when said upper lock bolts are removed from said handle and said posts, whereby said leg exerciser can be folded, when not in use, for storage and transport purposes.

* * * * *